US009601281B2

(12) United States Patent
Zehnder et al.

(10) Patent No.: US 9,601,281 B2
(45) Date of Patent: Mar. 21, 2017

(54) MULTIPHASE CIRCUIT BREAKER SYSTEM HAVING A SHORT-CIRCUIT LINK

(71) Applicant: ABB Technology AG, Zürich (CH)

(72) Inventors: Lukas Zehnder, Baden-Dättwil (CH); Andreas Nohl, Uhwiesen (CH)

(73) Assignee: ABB Schweiz AG, Baden (CH)

( * ) Notice: Subject to any disclaimer, the term of this patent is extended or adjusted under 35 U.S.C. 154(b) by 238 days.

(21) Appl. No.: 14/524,751

(22) Filed: Oct. 27, 2014

(65) Prior Publication Data

US 2015/0116886 A1 Apr. 30, 2015

(30) Foreign Application Priority Data

Oct. 25, 2013 (EP) ..... 13190375

(51) Int. Cl.

| | |
|---|---|
| ***H01H 9/00*** | (2006.01) |
| ***H01H 9/12*** | (2006.01) |
| ***H01H 31/00*** | (2006.01) |
| *H01H 79/00* | (2006.01) |

(52) U.S. Cl.

CPC ..... *H01H 9/0072* (2013.01); *H01H 31/003* (2013.01); *H01H 79/00* (2013.01)

(58) Field of Classification Search

CPC ..... H01H 9/0072; H01H 9/12; H01H 31/003; H01H 79/00; H01H 2239/018

USPC ..... 361/115

See application file for complete search history.

(56) References Cited

U.S. PATENT DOCUMENTS 5,495,372 A * 2/1996 Bahlmann ..... H02P 6/34 318/560

FOREIGN PATENT DOCUMENTS

WO WO 2012/171694 A1 12/2012

OTHER PUBLICATIONS

European Search Report for EP 13190375 dated Mar. 17, 2014.

ABB: "Generator Circuit Breaker HECS", Oct. 26, 2011, cited on internet—http://www05.abb.com/global/scot/scot245.nsf/veritydisplay/d3e2d8908070c731c1257935003f8f8d/$file/hecs_1hc0072302aa_en_high.pdf.

* cited by examiner

*Primary Examiner* — Thienvu Tran
*Assistant Examiner* — Kevin J Comber
(74) *Attorney, Agent, or Firm* — Taft Stettinius & Hollister LLP

(57) ABSTRACT

The circuit breaker system contains a plurality of phase conductors, a circuit breaker having a plurality of breaker poles, and a short-circuit link having a star point and a plurality of link conductors combined at the star point. Each of the phase conductors is electrically conductively connected to in each case one of the breaker poles and each link conductor is electrically conductively connected to in each case one of the phase conductors in each case one of several first disconnectors to which short-circuit current can be applied. In order to avoid expenditure on assembly and downtimes of the circuit breaker system when carrying out simulation experiments with the aid of the short-circuit link, the circuit breaker system contains a second disconnector which, when closed, electrically conductively connects the star point to ground and which is opened when a short-circuit current is applied to the short-circuit current link.

7 Claims, 2 Drawing Sheets

MULTIPHASE CIRCUIT BREAKER SYSTEM HAVING A SHORT-CIRCUIT LINK

TECHNICAL FIELD

The present invention relates to a circuit breaker system as claimed in the introductory part of patent claim 1.

A circuit breaker system of this kind contains a plurality of phase conductors, a circuit breaker having a plurality of circuit breaker poles, and a short-circuit link which has a star point and a plurality of link conductors which are combined at the star point. A circuit breaker system of this kind can be used, with the aid of the short-circuit link, to check safety settings and simulate possible fault situations when starting up power plants or switchgear assemblies.

PRIOR ART

A circuit breaker system of the abovementioned type is described in the product brochure "Generator Circuit-Breaker Systems HECS" from ABB Schweiz AG, Zurich/Switzerland (1 HC0072302 E02/AA09). The described circuit breaker system is in the form of a generator circuit breaker system and has selectively one of two short-circuit links, of which one is designed such that it can be manually installed and the other is designed such that it can be operated by motor. Trained installation personnel are required to set up the two short-circuit links, and set-up is therefore comparatively complicated and time-consuming.

SUMMARY OF THE INVENTION

The invention, as specified in the patent claims, is based on the object of providing a circuit breaker system of the kind cited in the introductory part which allows simulation experiments to be carried out with the aid of a short-circuit link in a time- and cost-saving manner.

The present invention provides a circuit breaker system containing a plurality of phase conductors, a circuit breaker having a plurality of breaker poles, and a short-circuit link which has a star point and a plurality of link conductors which are combined at the star point, wherein each of the phase conductors is electrically conductively connected to in each case one of the breaker poles, and wherein each link conductor is electrically conductively connected to in each case one of the phase conductors by means of in each case one of several first disconnectors to which short-circuit current can be applied. Said breaker system further contains a second disconnector which, when it is closed, electrically conductively connects the star point to ground and which is opened when a short-circuit current is applied to the short-circuit link.

Simulation experiments which serve to check the safety settings of power plants or switchgear assemblies or to simulate fault situations can be carried out centrally by a control center in the circuit breaker system according to the invention. The use of trained installation personnel is therefore dispensed with, and, firstly, assembly costs can be saved in this way. Secondly, downtimes of the circuit breaker system which are necessary for installation and removal work are also avoided in this way at the same time.

In the circuit breaker system according to the invention, the second disconnector can be designed such that a ground current can be applied to said second disconnector, said ground current being lower than a maximum permissible short-circuit current in the short-circuit link.

Advantageously, the first disconnector and the second disconnector can each have a drive, which can be driven by a central control system, for opening and closing an isolating gap, the phase conductors, the breaker poles of the circuit breaker and the first disconnector can be arranged in a grounded encapsulation, the star point can be arranged outside the encapsulation, each of the link conductors can be routed out of the encapsulation in an electrically insulated manner, and, when the second disconnector is closed, each of the first disconnectors can form in each case one of several earthing switches of the circuit breaker system.

The circuit breaker system according to the invention may be intended for installation in an outgoing generator line which is arranged between a generator and a transformer, wherein each of the link conductors electrically conductively connects a generator-end section of in each case one of the phase conductors to the star point by means of in each case one of the first disconnectors. The second disconnector can then be in the form of a medium-voltage circuit breaker or in the form of a low-voltage circuit breaker.

The circuit breaker system according to the invention may also be intended for installation in a gas-insulated metal-encapsulated high-voltage switchgear assembly. The second disconnector can be in the form of a high-voltage circuit breaker in this case.

BRIEF DESCRIPTION OF THE DRAWINGS

The invention will be explained in greater detail below with reference to drawings, in which.

WAYS OF IMPLEMENTING THE INVENTION

Figure 1:
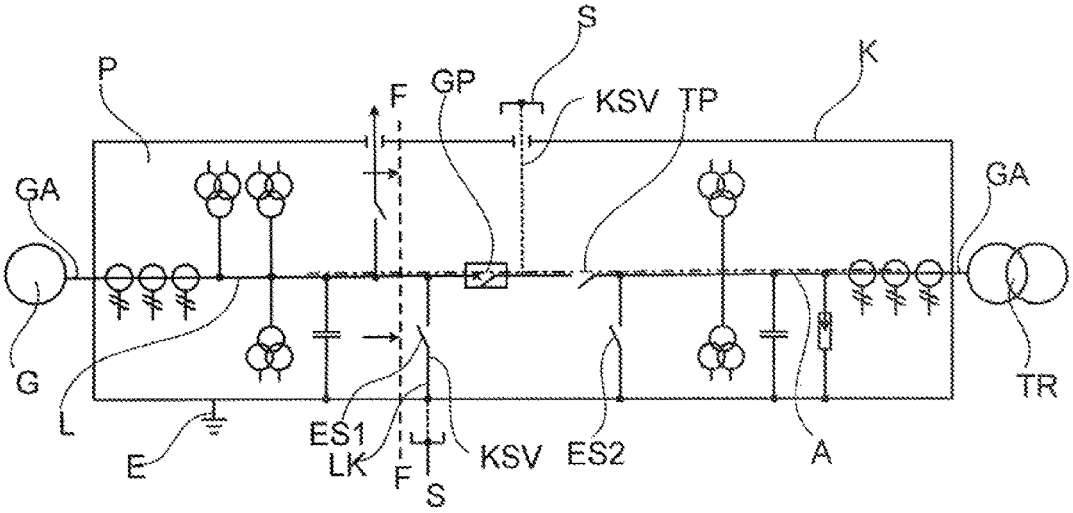
Prior Art Fig.1
FIG. 1 shows a single-phase illustration of a multiphase circuit breaker system according to the prior art, which multiphase circuit breaker system is in the form of a three-phase generator circuit breaker system and has three poles of the circuit breaker system, which poles are arranged in a grounded encapsulation and are arranged between a generator of a power plant and a transformer of a high-voltage transmission system in an outgoing generator line which is oriented along one axis.

The three-phase generator circuit breaker system illustrated in a single phase in FIG. 1 shows only one of three circuit breaker system poles P which are of largely identical design and which are oriented parallel to one another and to a horizontal axis A. The poles are arranged in a plane which extends horizontally and are connected between a generator G of a power plant and a transformer TR of a high-voltage transmission system in an outgoing generator line GA which is oriented along the axis. The illustrated pole P is of single-phase-encapsulated design and has a generally metal encapsulation K which is routed to ground E in an electrically conductive manner and is filled with ambient air. The encapsulation K accommodates a phase conductor L which is routed parallel to the axis A and into which in each case one breaker pole GP of a three-phase generator circuit breaker and one breaker pole TP of a three-phase disconnector are integrated in a manner connected in series. In addition to further components, such as current and voltage converters and overvoltage protection apparatuses for example, the encapsulation further also accommodates two earthing switches ES1 and ES2, one of which, specifically ES1, electrically conductively connects a generator-end current connection to the encapsulation K, and therefore also to ground E, when it is closed, and the other, specifically ES2, electrically conductively connects a transformer-end current connection of the system pole P to said encapsulation K, and therefore also to ground E, when it is closed.

Reference symbol KSV denotes two short-circuit links. Each of these two short-circuit links electrically conductively connects the phase conductors L of the three phases to a star point S which is arranged in an electrically insulated manner. Therefore, the link conductors LK of the short-circuit link KSV, which link conductors connect the star point S to in each case one of the phase conductors L, are routed through the encapsulation K in an electrically insulated manner and the star point S is located outside the encapsulation. A short-circuit link KSV of this kind can be used to check safety settings and simulate possible fault situations when starting up power plants and switchgear assemblies.

The short-circuit link KSV can be manually installed before the generator circuit breaker system is started up or after operation of said system is interrupted, this being achieved by disconnecting the operating current and by subsequently connecting the generator-end current connection and the transformer-end current connection of the breaker poles P to ground with the aid of the closed earthing switches ES1 and ES2. After the earthing switches ES1 and ES2 are opened, short-circuit current can be fed to the short-circuit link KSV by closing the breaker poles GP of the generator circuit breaker, and the simulation experiments can now be carried out.

In order to allow normal operation of the generator circuit breaker system, the manually installed short-circuit link is intended to be manually removed again after the experiments are complete. To this end, the earthing switches ES1 and ES2 are initially closed after the breaker poles GP are opened, and the short-circuit link KSV is then manually removed from the circuit breaker system. In addition to removing the short-circuit link, care should also be taken here that openings in the encapsulation K, through which the link conductors LK have been routed during installation as prescribed by regulations, are again closed as prescribed by regulations.

Figure 2:
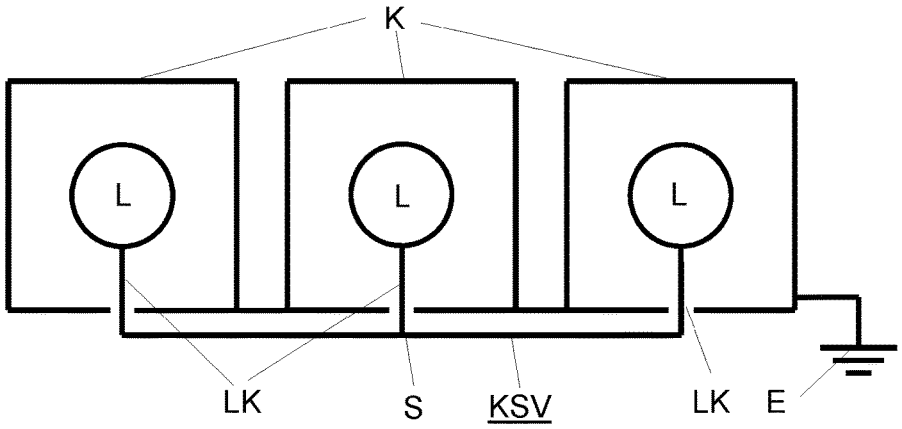
FIG. 2 shows a plan view, in the arrow direction, of a section, which is made perpendicular to the axis along F-F, through one embodiment of the circuit breaker system according to FIG. 1 which is illustrated largely true to shape, having a short-circuit link which can be installed manually, said section showing the geometric design and arrangement of the encapsulation and also of the phases and of a short-circuit link of said circuit breaker system.

A short-circuit link KSV which is of manual design is illustrated above the axis A in FIG. 1. FIG. 2 shows that, in the case of such a short-circuit link, each of the three link conductors LK ensures an interruption-free electrically conductive connection between in each case one of the phase conductors L and the star point S.

Figure 3:
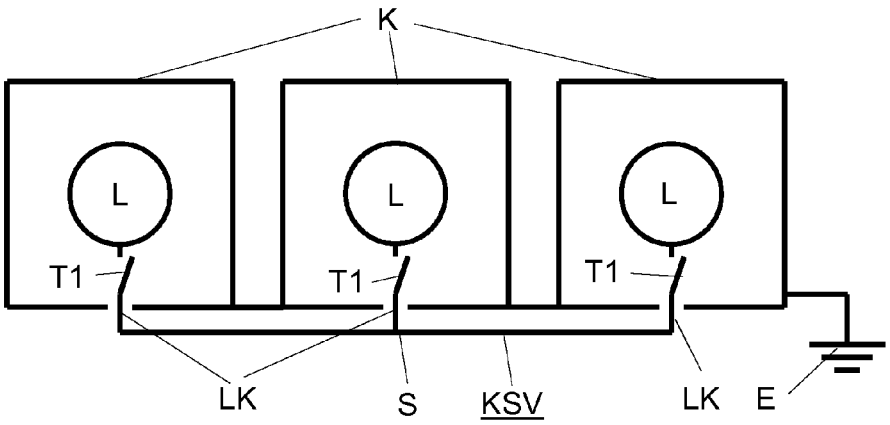
FIG. 3 shows a plan view of a section, which is made in a manner corresponding to FIG. 2, through one embodiment of the circuit breaker system according to FIG. 1 which is illustrated largely true to shape, having a short-circuit link which can be operated by motor, said section showing the geometric design and arrangement of the encapsulation and also of the phases and of a short-circuit link of said circuit breaker system.

FIG. 1 also illustrates—beneath the axis A—a further short-circuit link KSV. This short-circuit link can be produced with the aid of disconnectors which can be operated by motor, and is explained in greater detail in FIG. 3. As shown in FIG. 3, this short-circuit link has three disconnectors T1 which are arranged in the interior of the encapsulation K and which are each installed in the conductor track of in each case one of the three link conductors LK with an isolating point which is formed when said disconnectors are opened. Motor-operated closing of the disconnectors T1 bridges the three isolating points and forms the short-circuit link KSV which is required for the simulation experiments and to which short-circuit current is fed when the simulation experiments are carried out by closing the three breaker poles GP, shown in FIG. 1, of the generator circuit breaker. After the simulation experiments are complete, the breaker poles GP are opened and the current connections of the breaker system poles P and the short-circuit link KSV are grounded by closing the earthing switches ES1 and ES2 which are likewise shown in FIG. 1. Trained installation personnel can now connect the star point S to ground E in a constant manner with the aid of a suitable current link. After the disconnectors T1 and the earthing switches ES1 and ES2 are opened, the short-circuit link KSV is interrupted and connected to ground at the star point which is situated outside the encapsulation. Normal operation of the generator circuit breaker system can now be resumed.

In contrast to the above-described generator circuit breaker system, the use of the disconnectors T1 reduces the expenditure on installing and removing the short-circuit link KSV, but the installation and removal work which are still necessary considerably delay and make it more expensive to execute the simulation experiments and also to subsequently start up the generator circuit breaker system.

Figure 4:
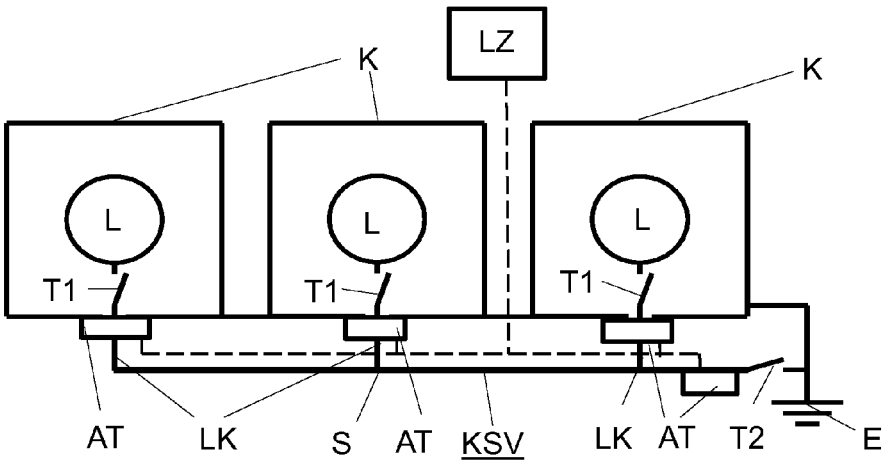
FIG. 4 shows a plan view of a section, which is made in a manner corresponding to FIGS. 2 and 3, through one embodiment of a three-phase circuit breaker system according to the invention which is illustrated largely true to shape.

The embodiment of the circuit breaker system according to the invention which is illustrated in FIG. 4, like the prior art system according to FIG. 1, is likewise in the form of a three-phase generator circuit breaker system and therefore also has the components which are shown in FIG. 1, such as encapsulation K, phase conductors L, generator circuit breaker with breaker poles GP, short-circuit link KSV and earthing switches ES1 and ES2, in particular. In contrast to the embodiment according to FIG. 3 however, said embodiment of the circuit breaker system illustrated in FIG. 4 also has a single-phase disconnector T2 which electrically conductively connects the star point S to ground E when it is closed and which is opened when a short-circuit current is applied to the short-circuit link KSV. Since only ground current is applied to said disconnector, said ground current being smaller than the maximum permissible short-circuit current which flows in the short-circuit link KSV during the simulation experiments, and since the voltage which is dropped across the open disconnector T2 is generally low, said disconnector can be designed in a cost-effective manner as a medium-voltage circuit breaker with rated voltages of typically 10 to 40 kV. Since a generally uniform current is applied to the phases in the experiments, as in the case of simulation experiments in power plants in particular, the disconnector T2 can often even be in the form of a low-voltage circuit breaker. The disconnectors T1 can then be advantageously arranged in the link conductors LK which each electrically conductively connect a generator-end section of one of the phase conductors L to the star point S by means of in each case one of the disconnectors T1. The generator-end section of the phase conductors L contains the generator-end current connection of the breaker system poles P which is discussed in relation to FIG. 1.

During normal operation of the circuit breaker system according to FIG. 4, the star point S is grounded by means of the closed disconnector T2. If simulation experiments with short-circuit currents are now intended to be carried out, the breaker poles GP of the generator circuit breaker are first opened and then the disconnectors T1 are closed. Since the disconnectors T1 are electrically conductively connected to ground E by means of the closed disconnector T2, said disconnectors T1 now form the earthing switches ES1 and connect the generator-end sections of the three phase conductors L to ground E. The short-circuit link KSV is then formed by subsequently opening the disconnector T2 with the disconnectors T1 closed and the generator circuit breaker open. Short-circuit current can be fed to the link KSV by subsequently closing the generator circuit breaker, and the simulation experiments can then be carried out.

After the experiments are complete, the generator circuit breaker is opened again and, with the generator circuit breaker open, the disconnectors T1 are then opened and, with the disconnectors T1 open, the disconnector T2 is closed, as a result of which the disconnectors T1 again form the earthing switches ES1 and the circuit breaker system can again be operated as intended.

As shown in FIG. 4, both the three earthing switches T1 and the earthing switch T2 each have a drive AT, which can be driven by a central control system LZ, for opening and closing an isolating gap in the link conductor LK. Therefore, in the case of a generator circuit breaker system of this kind, the simulation experiments can be executed from the central control system "at the press of a button" and the employment of trained installation personnel is dispensed with. This saves on installation costs, but at the same time also avoids downtimes of the generator circuit breaker system which are required for installation and removal work.

The circuit breaker system according to the invention is not restricted to an encapsulated generator circuit breaker system which can be installed between a generator of a power plant and a transformer of a high-voltage power supply system; said circuit breaker system can also be used in a gas-insulated metal-encapsulated high-voltage system. The earthing switch TR2 is generally in the form of a high-voltage circuit breaker in this case.

The circuit breaker system according to the invention does not necessarily require an encapsulation K and can therefore also be installed in outgoing generator lines which are kept free of an encapsulation, or else in outdoor switchgear assemblies.

Instead of three phase conductors, the circuit breaker system according to the invention can also contain four or more phase conductors.

LIST OF REFERENCE SYMBOLS

A Axis
AT Drives
E Ground
ES1, ES2 Earthing switches
F-F Section
G Generator
GA Outgoing generator line
GP Circuit breaker pole
K Encapsulation
KSV Short-circuit link
L Phase conductor
LK Link conductor
LZ Central control system
P Circuit breaker system pole
S Star point
TP Disconnector pole
T1, T2 Disconnector
TR Transformer

The invention claimed is:

1. A circuit breaker system containing a plurality of phase conductors, a circuit breaker having a plurality of breaker poles, and a short-circuit link which has a star point and a plurality of link conductors which are combined at the star point, wherein each of the phase conductors is electrically conductively connected to in each case one of the breaker poles, and wherein each link conductor is electrically conductively connected to in each case one of the phase conductors by means of in each case one of several first disconnectors to which short-circuit current can be applied, wherein the circuit breaker system further has a second disconnector which, when it is closed, electrically conductively connects the star point to ground and which is opened when a short-circuit current is applied to the short-circuit link.

2. The circuit breaker system as claimed in claim 1, wherein a ground current is applied to the second disconnector, said ground current being lower than a maximum permissible short-circuit current in the short-circuit link.

3. The circuit breaker system as claimed in claim 1, wherein the first disconnectors and the second disconnector each have a drive, which can be driven by a central control system, for opening and closing an isolating gap.

4. The circuit breaker system as claimed in claim 1, wherein the phase conductors, the breaker poles of the circuit breaker and the first disconnectors are arranged in a grounded encapsulation, in that the star point is arranged outside the encapsulation, in that each of the link conductors is routed out of the encapsulation in an electrically insulated manner, and in that, when the second disconnector is closed, each of the first disconnectors forms in each case one of several earthing switches of the circuit breaker system.

5. The circuit breaker system as claimed in claim 4 for installation in an outgoing generator line which is arranged between a generator and a transformer, wherein each of the link conductors electrically conductively connects a generator-end section of in each case one of the phase conductors to the star point by means of in each case one of the first disconnectors.

6. The circuit breaker system as claimed in claim 5, wherein the second disconnector is in the form of a medium-voltage circuit breaker or in the form of a low-voltage circuit breaker.

7. The circuit breaker system as claimed in claim 4 for installation in a gas-insulated metal-encapsulated switchgear assembly, wherein the second disconnector is in the form of a circuit breaker.

* * * * *